US010953409B2

(12) United States Patent
Pitkämäki

(10) Patent No.: US 10,953,409 B2
(45) Date of Patent: Mar. 23, 2021

(54) CENTRIFUGAL SEPARATOR WITH INTERMITTENT DISCHARGE OF HEAVY PHASE

(71) Applicant: ALFA LAVAL CORPORATE AB, Lund (SE)

(72) Inventor: Jouko Pitkämäki, Eskilstuna (SE)

(73) Assignee: ALFA LAVAL CORPORATE AB, Lund (SE)

( * ) Notice: Subject to any disclaimer, the term of this patent is extended or adjusted under 35 U.S.C. 154(b) by 204 days.

(21) Appl. No.: 15/762,919

(22) PCT Filed: Oct. 11, 2016

(86) PCT No.: PCT/EP2016/074324
§ 371 (c)(1),
(2) Date: Mar. 23, 2018

(87) PCT Pub. No.: WO2017/064053
PCT Pub. Date: Apr. 20, 2017

(65) Prior Publication Data

US 2018/0207649 A1 Jul. 26, 2018

(30) Foreign Application Priority Data

Oct. 12, 2015 (EP) ..... 15189390

(51) Int. Cl.
*B04B 1/14* (2006.01)
*B04B 7/02* (2006.01)

(52) U.S. Cl.
CPC . *B04B 1/14* (2013.01); *B04B 7/02* (2013.01)

(58) Field of Classification Search
CPC ..... B04B 1/14; B04B 7/02
(Continued)

(56) References Cited

U.S. PATENT DOCUMENTS 4,017,023 A 4/1977 Hemfort
4,081,129 A * 3/1978 Stroucken ..... B04B 1/14 494/41

(Continued)

FOREIGN PATENT DOCUMENTS

CN 86102095 A 10/1986
CN 102341180 A 2/2012

(Continued)

OTHER PUBLICATIONS

European Search Report, issued in Application No. 15189390, dated Mar. 24, 2016.

(Continued)

*Primary Examiner* — Walter D. Griffin
*Assistant Examiner* — Shuyi S. Liu
(74) *Attorney, Agent, or Firm* — Birch, Stewart, Kolasch & Birch, LLP

(57) ABSTRACT

A centrifugal separator includes a casing which delimits a space which is sealed off from and having an under pressure in relation to the surroundings, by at least one seal. A rotor is arranged for rotation around a rotational axis and forms within itself a separation space. In the separation space, centrifugal separation of at least one higher density component and at least one lower density component from a fluid takes place during operation. At least one inlet extends into the rotor for introducing the fluid to the separation space. At least one first outlet extends from the rotor for discharge of at least one component separated from the fluid during operation. The rotor includes at least one second outlet extending from a portion of the separation space to the space for discharge of at least one higher density component separated from the fluid during operation. The second outlet is arranged for intermittent discharge by an intermittent
(Continued)

discharge system and one of the seals is formed by the intermittent discharge system.

3 Claims, 3 Drawing Sheets

(58) Field of Classification Search
USPC ..... 494/14, 13, 37, 38, 40, 41
See application file for complete search history.

(56) References Cited

U.S. PATENT DOCUMENTS

| | | | | |
|---|---|---|---|---|
| 5,885,202 | A | 3/1999 | Ostkamp | |
| 6,015,375 | A | 1/2000 | Moss | |
| 6,616,589 | B1 * | 9/2003 | Maehans | B04B 1/08 494/37 |
| 2012/0040816 | A1 * | 2/2012 | Thorwid | B04B 15/08 494/14 |

FOREIGN PATENT DOCUMENTS

| | | | |
|---|---|---|---|
| CN | 203990959 | U | 12/2014 |
| DE | 1 141 949 | | 12/1962 |
| EP | 2403650 | B1 | 12/2016 |
| EP | 774684 | B1 | 10/2018 |
| JP | 3-224647 | A | 10/1991 |
| WO | WO 86/06006 | A1 | 10/1986 |
| WO | WO 2010/101524 | A2 | 9/2010 |
| WO | WO 2010/101524 | A3 | 9/2010 |

OTHER PUBLICATIONS

International Search Report, issued in PCT/EP2016/074324, dated Dec. 13, 2016.
Written Opinion of the International Searching Authority; issued in PCT/EP2016/074324, dated Dec. 13, 2016.
Chinese Office Action and Search Report, dated Apr. 26, 2019, for Chinese Application No. 201680059221.3.

* cited by examiner

CENTRIFUGAL SEPARATOR WITH INTERMITTENT DISCHARGE OF HEAVY PHASE

TECHNICAL FIELD

The invention relates to a centrifugal separator with intermittent discharge of heavy phase.

BACKGROUND

For a separator the energy consumption can be lowered by creating an under pressure around the rotor, i.e. the separator bowl. In order to create an air tight space around the separator bowl a sealing is used today between the machine top part and the separator casing. This sealing is expensive and not always robust and thus not completely reliable.

SUMMARY

It is an object to provide a new arrangement that contributes to sealing off the space around the rotor from the outside to make it possible to lower the pressure in said space and lower the energy consumption due to low air friction.

To fulfil these objects a centrifugal separator for separating a fluid mixture into components is provided.

The centrifugal separator comprises a casing which delimits a space which is sealed off from and having an under pressure in relation to the surroundings of the casing, by at least one seal; and in which a rotor is fastened to a shaft arranged for rotation around a rotational axis x and forming within itself a separation space, and in which separation space centrifugal separation of at least one higher density component and at least one lower density component from a fluid takes place during operation, into which rotor at least one inlet extends for introducing said fluid to the separation space, and from which rotor at least one first outlet extends for discharge of at least one component separated from the fluid during operation feed a fluid product to be separated into the separation space, and wherein the rotor comprises at least one second outlet extending from a portion of the separation space to the space for discharge of at least one higher density component separated from the fluid during operation, and wherein said second outlet is arranged for intermittent discharge by an intermittent discharge system and one of said seals is formed by said intermittent discharge system.

The seal may be a water seal, and may especially be positioned in a paring chamber in said intermittent discharge system.

The water seal may further be a labyrinth seal in said paring chamber.

Said labyrinth seal may comprise a stationary paring disc and a rotating wing protrusion arranged in said paring chamber.

Said stationary paring disc extends outwardly radially into the paring chamber to a first radial position and the wing protrusion extends inwardly radially into the paring chamber to a second radial position and the first radial position is further from the axis than is the second position to such an extent that said stationary paring disc and the wing protrusion form a labyrinth seal.

Still other objectives, features, aspects and advantages of the invention will appear from the following detailed description as well as from the drawings.

DRAWINGS

Embodiments of the invention will now be described, by way of example, with reference to the accompanying schematic drawings, in which FIG. 1 is a cross-sectional view of centrifugal separator.

DETAILED DESCRIPTION

Figure 1:
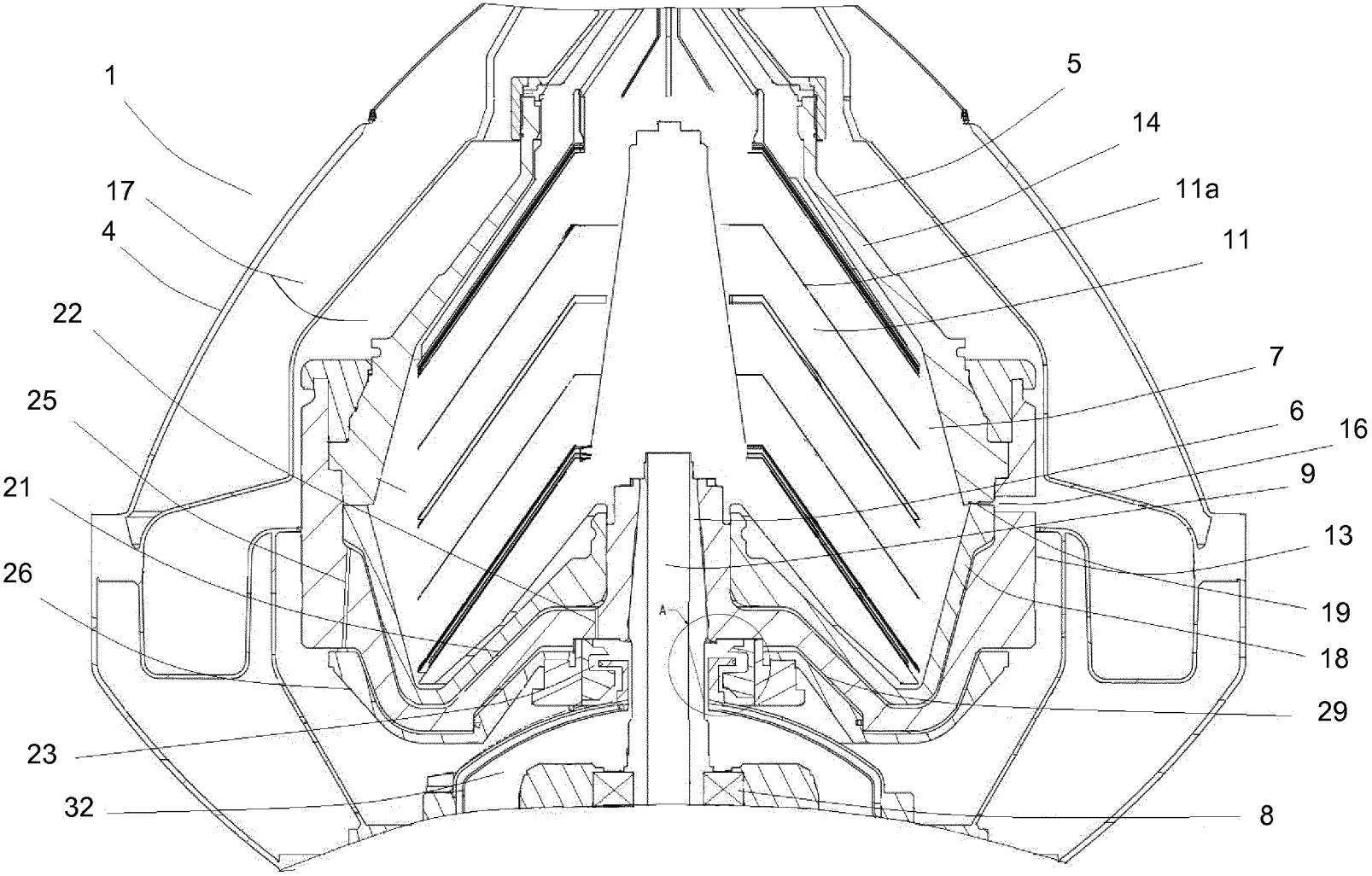
Figure 3:
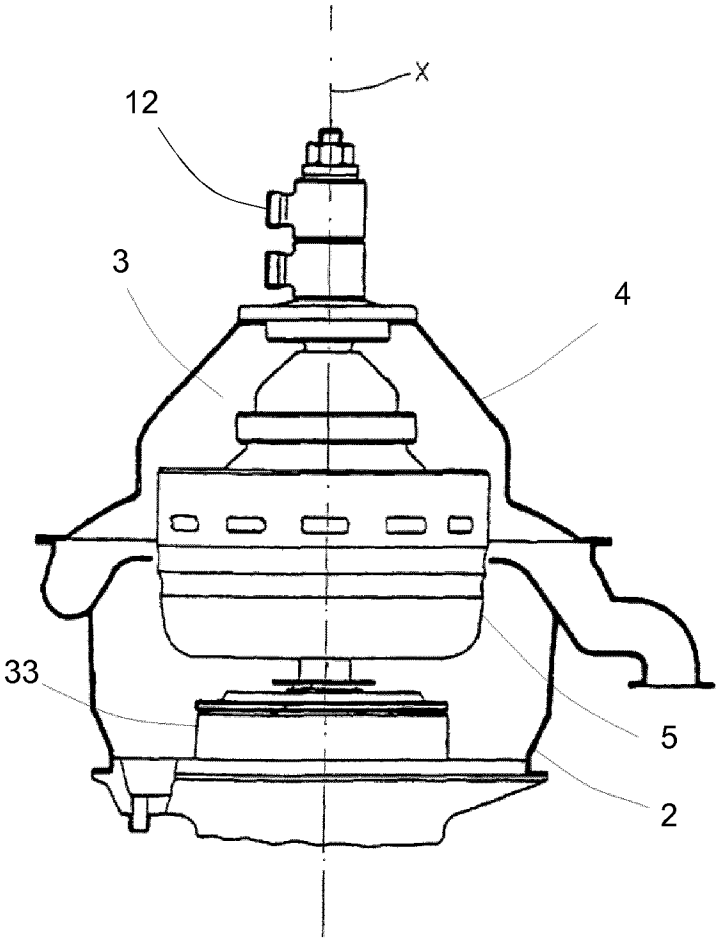
FIG. 3 is a schematic view of a centrifugal separator.

With reference to FIGS. 1 and 3 a centrifugal separator 1 is illustrated. The centrifugal separator comprises a non-rotating part 2 and a rotating part 3. The non-rotating part 2 comprises a casing 4. The rotating part 3 is configured to rotate around the axis of rotation x and comprises a rotatable centrifuge rotor 5 also called centrifuge bowl enclosed by the casing 4, and a shaft 6 to which the centrifuge rotor 5 is attached. The centrifuge rotor 5 encloses a separation space 7 in which the separation of a fluid mixture takes place. The shaft 6 is a hollow spindle journalled in a bearing arrangement 8 secured to the non-rotating part 2 and driven by a motor 33. The hollow spindle functions as an inlet tube 9 with an inlet channel 9*a* and is arranged to supply a suspension to be separated into separation space 7.

On leaving the inlet tube 9 the suspension comes into contact with a distributor 10 which accelerates the suspension up to same speed as the centrifuge rotor 5. The suspension enters the separation space 7 from under the distributor 10 which directs the fluid into a disk set 11, comprising conical separator discs 11*a* stacked concentrically outside of the distributor 10. Nearly all the separation is carried out in the spaces between the discs 11*a*. In operation due to the rotational forces, the heavy phase separated in the disk set 10 forms a layer in the periphery of the separation space 7, while the light phase is collecting radially inside and is further transported out of the separation space 7 to an outlet 12 at the top of the centrifuge rotor 5.

The bowl comprises a bowl body 13 and a bowl hood 14 connected with each other. In the bowl around its circumference is a plurality of ports 16 arranged for intermittent transport of the heavy phase out of the bowl 5 into a space 17 between the cover 4 and the centrifuge rotor 5. In order to lower the energy consumption for the separator, means are arranged for creating an under-pressure in the space 17, possibly near vacuum, e.g. a vacuum pump.

Within the rotor there is arranged an annular sliding bowl bottom 18 which is axially movable a short distance to and from abutment against a lower annular edge portion 19 of the bowl hood 14 under radial sealing against the bowl body 13 centrally within the centrifuge rotor 5. The movement to and from said abutment regulates the free passage from the separation space 7 through the ports 16 to a space between the cover 4 and the centrifuge rotor 5 in such a way that when the sliding bowl bottom 18 abuts against the lower annular edge portion 19 the passage is closed and when the sliding bowl bottom 18 is out of abutment the passage is open. For obtaining this movement of the sliding bowl bottom 18 a discharge operating system is provided.

Figure 2:
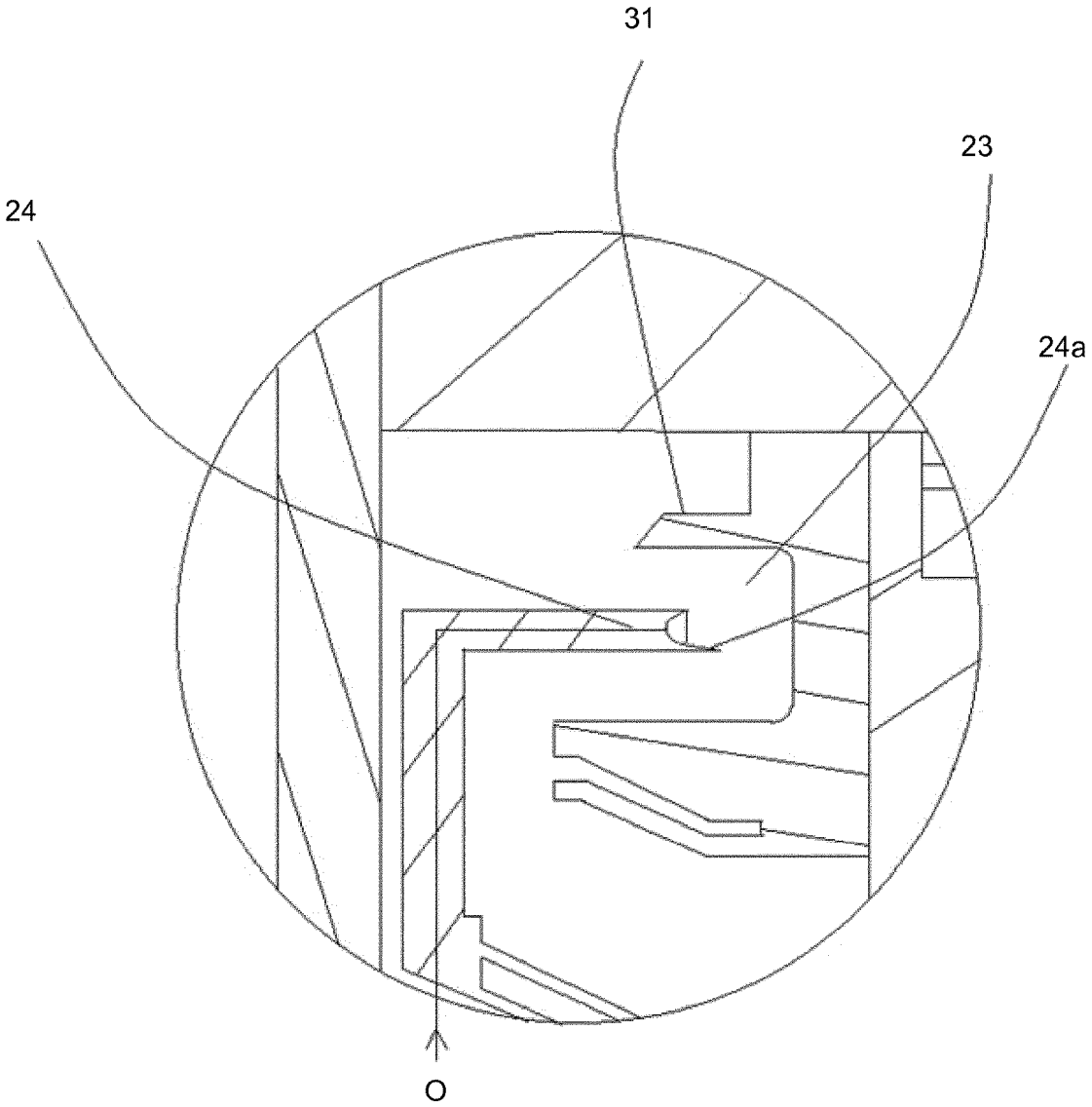
FIG. 2 is a detailed cross-sectional view taken of part A in FIG. 1.

Between the bowl body 13 and the sliding bowl bottom 18 there is formed an annular closing chamber 21 from which a constantly open channel 22 extends through the bowl body 13 to an annular paring chamber 23 positioned radially close to the shaft 6 and disclosed in FIG. 2.

Further referring to FIG. 2, the paring chamber 23 is constantly supplied with operating liquid (O) through a stationary paring disk 24. During operation (rotation) the operating liquid is streaming from the paring chamber 23 to the closing chamber 21 through the channel 22 thus exerting a force on the sliding bowl bottom 18 in proportion to its surface area. As the area in contact with the operating liquid underneath is greater than that in contact with the suspension above, the force upwards is greater than that directed downwards. As long as this situation exists, the sliding bowl bottom 18 will remain in the upward position in abutment closing of the heavy phase discharge ports 16.

To uncover the discharge ports 16 the force under the sliding bowl bottom 18 must be reduced by draining off the operating liquid from the closing chamber 21 through drain holes 25 to allow the force exerted by the suspension to push the sliding bowl bottom 18 down wards.

The paring disk 24 which has openings radially outwardly has a lower circular lip 24*a* extending further radially outwardly than the paring disk as a whole obstructing its opening downwardly. Thus the paring disk 24 extends outwardly radially into the paring chamber to a first radial position. Axially above the paring disk 24 attached to the bowl body 18 and extending radially inwardly into the paring chamber 23 to a second radial position is an annular wing protrusion 31 rotating with the rotor and reaching further inwardly than the lip 24*a* of the paring disk 24, thus forming a labyrinth seal, i.e. the first radial position is further from the axis x than is the second position to such an extent that said stationary paring disc and the wing protrusion 31 form a labyrinth seal. The wing protrusion 31 may be a separate wing insert arranged on the bowl body.

The space 17 between the cover 4 and the centrifugal rotor 5 has preferably as low pressure as possible in order to provide as little resistance as possible for the rotation of the rotor and is connected to the paring chamber 23. The bearing arrangement 8 is situated in a space 32 in which there is a relatively higher pressure, or close to atmospheric pressure. The space 32 is connected to the paring chamber 23 which also have a connection to the atmosphere. Thus the labyrinth seal does seal off the under pressurized space 17 from the space 32 where the bearings are arranged.

The rotor 5 supports on its underside an annular operating slide 26, which is axially movable relative to the rotor 5 in a way such that part of the operating slide 26 may close alternatively uncover the drain holes 25 thus closing off alternatively opening the closing chamber 21. To uncover the drain holes the operating slide 26 is lowered. When the drain holes are uncovered and the operating liquid in the closing chamber 21 is subsequently drained off and the sliding bowl bottom 18 falls toward the inner bottom surface of the bowl body 13.

There may be other seals between the rotating part 3 and the non-rotating part to seal off the Between the operating slide 26 and the outer bottom surface of the bowl body 13 there is delimited an annular so called opening chamber 29, which has at least one central inlet adjacent to the paring chamber 23. The central inlet is directed inwardly which means that when the paring chamber 23 is filling up, operating liquid is overflowing from the paring chamber 23. Under the influence of centrifugal force, the water exerts an increasing hydraulic force on the operating slide 26. The operating slide 26 begins to move downwards when this force exceeds that of a number of coil springs. Thus the drain holes 25 open and the closing chamber can be drained. As this happens, the upward force on the sliding bowl bottom 18 decreases until it becomes less than that exerted downward by the process liquid in the bowl and the sliding bowl bottom 18 drops uncovering the discharge ports 16. The sliding bowl bottom and its above disclosed operating system is part of an intermittent discharge system for intermittent discharge of at least one higher density component separated from the fluid during operation.

The invention claimed is:

1. A centrifugal separator comprising:

a casing which delimits a space which is sealed off from and having an under pressure in relation to the surroundings of the casing, by at least one seal; and a rotor arranged for rotation around a rotational axis and forming therein a separation space, wherein in the separation space, centrifugal separation of at least one higher density component and at least one lower density component from a fluid takes place during operation, wherein at least one inlet extends into said rotor for introducing said fluid to the separation space, wherein at least one first outlet extends from said rotor for discharge of at least one component separated from the fluid during operation, wherein the rotor comprises at least one second outlet extending from a portion of the separation space to said space delimited by the casing for discharge of at least one higher density component separated from the fluid during operation, wherein said at least one second outlet is arranged for intermittent discharge by an intermittent discharge system and one of said at least one seal is formed by said intermittent discharge system, and said at least one second outlet is configured as a plurality of ports arranged for intermittent transport of the at least one higher density component out of the separation space into the space delimited by the casing and between the casing and the rotor, wherein said seal is a water seal, the water seal is positioned in a paring chamber in said intermittent discharge system, and the water seal is a labyrinth seal in said paring chamber, and wherein said labyrinth seal comprises a stationary paring disc and a rotating wing protrusion arranged in said paring chamber.

2. The centrifugal separator according to claim 1, wherein said stationary paring disc extends outwardly radially into the paring chamber to a first radial position, and the wing protrusion extends inwardly radially into the paring chamber to a second radial position, and the first radial position is further from the axis than is the second position to such an extent that said stationary paring disc and the wing protrusion form said labyrinth seal.

3. A centrifugal separator comprising:

a casing which delimits a space which is sealed off from and having an under pressure in relation to the surroundings of the casing, by at least one seal; and a rotor arranged for rotation around a rotational axis and forming therein a separation space, wherein in the separation space; centrifugal separation of at least one higher density component and at least one lower density component from a fluid takes place during operation, wherein at least one inlet extends into said rotor for introducing said fluid to the separation space, wherein at least one first outlet extends from said rotor for discharge of at least one component separated from the fluid during operation, wherein the rotor comprises at least one second outlet extending from a portion of the separation space to said space delimited by the casing for discharge of at least one higher density component separated from the fluid during operation, wherein said at least one second outlet is arranged for intermittent discharge by an intermittent discharge system and one of said at least one seal is formed by said intermittent discharge system, and said at least one second outlet is configured as a plurality of ports arranged for intermittent transport of the at least one higher density component out of the separation space into the space delimited by the casing and between the casing and the rotor, and wherein the intermittent discharge system includes a paring chamber which is supplied with an operating liquid through a stationary paring disk, the paring chamber being positioned downstream of the separation space, and the operating liquid is supplied from the paring chamber to a sealing chamber in order to close the at least one second outlet.

* * * * *